US007726417B2

(12) United States Patent
Larsson

(10) Patent No.: US 7,726,417 B2
(45) Date of Patent: Jun. 1, 2010

(54) WATER COLLECTING DEVICE FOR CORE DRILLING DEVICE

(75) Inventor: Martin Larsson, Öjersjö (SE)

(73) Assignee: Husqvarna AB, Huskvarna (SE)

( * ) Notice: Subject to any disclaimer, the term of this patent is extended or adjusted under 35 U.S.C. 154(b) by 0 days.

(21) Appl. No.: 12/095,111

(22) PCT Filed: Nov. 28, 2006

(86) PCT No.: PCT/SE2006/001346

§ 371 (c)(1),
(2), (4) Date: May 27, 2008

(87) PCT Pub. No.: WO2007/061364

PCT Pub. Date: May 31, 2007

(65) Prior Publication Data

US 2008/0283302 A1 Nov. 20, 2008

(30) Foreign Application Priority Data

Nov. 28, 2005 (SE) ..... 0502609

(51) Int. Cl.
*E21B 21/00* (2006.01)
*B23B 51/06* (2006.01)
*B23B 47/00* (2006.01)

(52) U.S. Cl. ..... 175/207; 175/211; 175/213; 408/56; 408/67

(58) Field of Classification Search ..... 175/213, 175/414–417
See application file for complete search history.

(56) References Cited

U.S. PATENT DOCUMENTS 2,634,952 A 4/1953 Brinkley
6,712,162 B2 * 3/2004 Britz ..... 175/210

FOREIGN PATENT DOCUMENTS

DE 3126511 A1 3/1983
JP 10193333 A 7/1998
JP 11114947 A 4/1999
WO 2005095075 A1 10/2005

OTHER PUBLICATIONS

International Search Report for International Patent Application PCT/SE2006/001346, dated Feb. 20, 2007.

* cited by examiner

*Primary Examiner*—David J Bagnell
*Assistant Examiner*—Catherine Loikith
(74) *Attorney, Agent, or Firm*—Novak Druce + Quigg LLP

(57) ABSTRACT

The invention relates to a water collecting device (30) intended for a core drilling unit (1) that comprises a drilling machine including an electric drilling motor (6), a machine housing (3) with an output shaft (9), that can be composed of many sections, a core drill (4) connected to the machine shaft and means to supply cooling water, as required, to the cylindrical inner part of the of the core drill via the machine shaft (9). The water collecting device (30) comprises a vessel (31) with a bottom (32) and a side wall (33), the bottom (32) positioned below the core drill (4), the vessel (31) arranged to collect spent water as well as drill cuttings from the core drill (4), the vessel (31) further comprising at least a draining duct (58) for drainage of spent water as well as drill cuttings from the vessel (31). The invention also relates to the core drilling unit equipped with the water collecting device.

34 Claims, 7 Drawing Sheets

Fig. 8
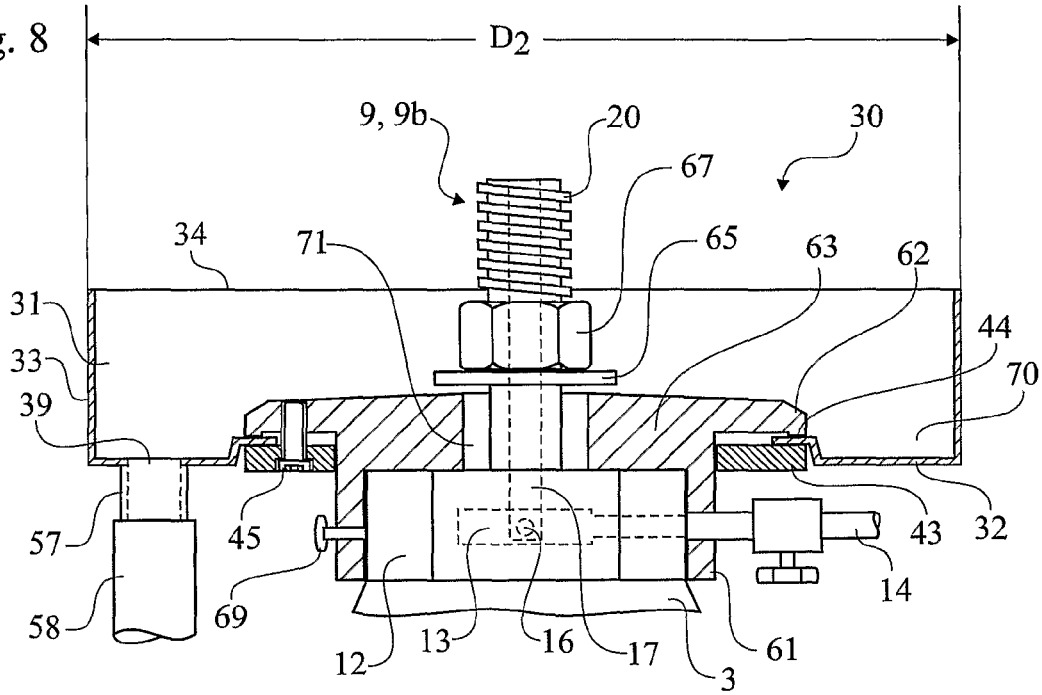
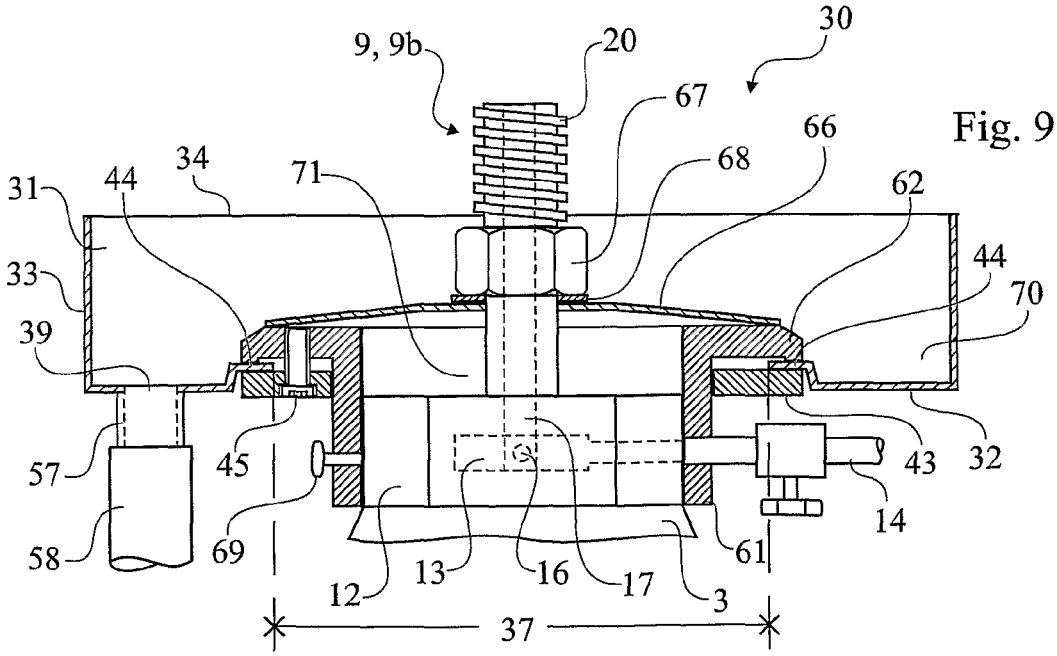
Fig. 9

WATER COLLECTING DEVICE FOR CORE DRILLING DEVICE

CROSS-REFERENCE TO RELATED APPLICATIONS

The present application is a U.S. national stage patent application International Application No. PCT/SE2006/001346 filed Nov. 28, 2006, published as WO 2007/061364 A1, which was published in English pursuant to Article 21(2) of the Patent Cooperation Treaty, and which claims priority to Swedish application No. 0502609-1 filed Nov. 28, 2005. Said applications are expressly incorporated herein by reference in their entireties.

TECHNICAL FIELD

The invention relates to a water collecting device intended for a core drilling unit comprising a drilling machine with an electric drilling motor with an output machine shaft, that can be composed of different sections, a core drill connectable with the machine shaft and means to supply cooling water to the cylindrical inner part of the core drill. The invention also relates to the core drilling unit of mentioned type and that is provided with mentioned device to collect the spent cooling water that during drilling flows downwards along the outside of the core drill towards the drilling motor underneath the core drill.

THE BACKGROUND OF THE INVENTION

An automatically operating core drilling unit of above mentioned type is described in PCT/SE2005/000472. Similar units are produced and marketed by the Dimas company, associated with the applicant, under the brand name Dimas DS40/50 Gyro and is also described in Dimas' brochures, see also www.dimas.com. By means of these and other core drilling units, it is possible to drill vertically in ceilings as well. Water is hereby, according to prior art, fed into the cylindrical cavity in the core drill via a duct that extends through the machine shaft, ending at the bottom of the cylinder formed by the core drill, so that the core drill is fully filled by cooling liquid. During drilling, the water is pressed upwards through the circular drilling cut that is formed in the ceiling, after which the water including the drill cuttings will flow downwards along the outside surface of the drill. Measures must consequently be taken to prevent water from flowing down onto the drilling machine underneath the drill, otherwise there is a risk of short-circuiting the drilling motor and/or other damage occurring in the machine. However, there are no good devices available to collect and divert the water, so that it does not come in contact with the drilling machine. Lacking better solutions, it is therefore common practice to cover the drilling machine including the drilling motor with plastic film. This is however troublesome and does not in any case constitute a reliable solution to the problem of protecting the drilling machine including the drilling motor from water damage. Besides, the cooling water with the drill cuttings from the plastic foil covering flows down onto the floor, from where it has to be removed in some way. It can be understood that core drilling in ceilings therefore constitutes a dirty and from many aspects unpleasant task.

BRIEF DESCRIPTION OF THE INVENTION

The purpose of the invention is to remedy the above mentioned problem. According to the invention, a water collecting device—from now on also named a water collector—is arranged above the drilling machine but below the core drill, the water collector comprising a vessel with a bottom and a side wall, the bottom of the vessel arranged below the core drill, the vessel arranged to collect spent water including drill cuttings from the core drill, at least a first hole in the bottom of the vessel, and that the drilling machine is arranged in the mentioned first hole so that the vessel's side wall is enclosing at least a certain part of the drilling machine.

The collecting vessel of the water collector is wider than the core drill, i.e. the diameter of the upper edge of the vessel's side wall is greater than the diameter of the core drill, in the case that the upper edge of the vessel is circular, which is the typical shape. This does not exclude other shapes, but if other shapes than a circular should be preferred, then the smallest width of the vessel must be larger than the diameter of drill in order for all the water flowing down along the outside of the drill to end up in the water collector.

There is preferably a draining hole at the bottom of the vessel. From this hole there is a draining duct, that can be connected to a suction pump in order to effectively remove the polluted water that is gradually gathering in the water collector. Obviously the vessel could also be designed without a draining hole. The draining duct would then be drawn from the bottom of the vessel and above the side wall of the vessel.

In the embodiment to be described below, the water collector has the shape of a vessel with a plane bottom and a circular, cylindrical wall. The height of the wall is significantly smaller than the diameter of the vessel. Typically the height corresponds to 10-40, preferably 20-30, percent of the diameter.

Other shapes of the water collecting vessel than the purely cylindrical can be conceived. For example, the bottom can be curved in bowl-shape and the wall be at an angle. The vessel can also be given a geometrical shape that prevents the spent cooling water from sloshing and splashing when falling down into the vessel. Additional members are conceivable, e.g. a grating arrangement in the opening of the vessel, comprising ring-shaped angled members, concentrically arranged around the machine shaft or similar, that can prevent water splashing out sideways and/or splashing up from the bottom. To further reduce the risk of splashing, a screen can be arranged around the vessel, extending a part of the way upwards around the core drill. Such a screen can comprise an additional member that is mounted on the vessel after that the vessel has been assembled on the machine shaft.

Furthermore, the vessel can be arranged with an outer trough along the side wall of the vessel, whereby most of the spent water and the drill cuttings can be arranged to end up in the outer trough and that the draining duct is arranged in conjunction with the outer trough.

According to a first embodiment, an against the bottom sealed bearing housing is arranged in a first hole in the bottom of the vessel, at least a coaxially arranged bearing in the bearing housing, through which the machine shaft is extending when the water collector is mounted in such a way that the shaft can rotate inside the water collector. In the first embodiment the draining duct is also acting as a rotational stop for the water collector. Indeed, the mentioned bearing, suitably a ball bearing, preferably comprises two above each other arranged ball bearings, but even ball bearings have a certain, although low, friction, that could result in that the water collecting vessel gradually would start rotating due to the rotation of the drill shaft in the vessel. The draining hose, particularly when the draining hose is connected to the mentioned suction pump or fixed in other ways, is fully capable of balancing the small rotating force transferred from the machine shaft to the water collector via mentioned bearing.

According to further embodiments, a second sleeve is arranged in the first hole in the bottom of the vessel, and around the upper portion of the machine housing, mentioned second sleeve sealed against the upper portion of the machine housing and against the vessel. The second sleeve is protruding above the bottom of the vessel so that an inner space around the machine shaft is separated from the outer trough.

In a second embodiment, the second sleeve has an inner second flange extending towards the machine shaft 9 and thus reducing the inner space around the machine shaft, and the machine shaft can comprise a third flange, where the third flange has a radial extension covering the inner space around the machine shaft. This prevent spent water and drill cuttings to enter the inner space.

In a third embodiment, a conically shaped cover plate is used, covering the inner space, the cover plate being arranged with a centred hole for the machine shaft, and where the apex of the cone is directed towards the core drill. The conically shaped cover plate is arranged to be flexible in the vertical direction and a radially extending part of the machine shaft is pressing the cover plate at the cone apex against a part of the other sleeve's top side, and where preferably a seal with low friction is arranged between the extending part and the cone apex of the cover plate. The cover plate prevents spent water and drill cuttings from entering the inner space.

Furthermore, the core drill can be provided with a detachable sleeve surrounding and sealed against the lower end of the core drill above the vessel, the detachable sleeve extending below the core drill's underside, whereby spent water and drill cuttings flowing down along the sides of the core drill are prevented to flow along the bottom of the core drill towards the machine shaft.

In the designation 'machine shaft' is, per definition in this text, also included one or many adapters, that can be or are connected to the output shaft of the drill motor in a per se known manner, i.e. constitute extensions of the output shaft.

I the contexts where directional expressions, such as below, underneath, above, etc., are used in the description, they reference the core drill being arranged for drilling upwards, for instance in a ceiling.

Further characteristics and aspects of the invention are described in the following patent claims and in the following description of the preferred embodiments of the core drilling unit and its water collecting device.

BRIEF DESCRIPTION OF THE FIGURES

In the following description of the preferred embodiments of the water collecting device and the core drilling unit provided with the water collecting device according to the invention, reference will be made to the appended drawings in different figures, of which

FIG. 8 shows a side view in greater scale, partly in cross section, of the water collecting device according to a second embodiment, and a machine shaft, the water collecting device being fixed around the water connector 12, FIG. 9 shows a side view in greater scale, partly in cross section, of the water collecting device according to a third embodiment, and a machine shaft, the water collecting device being fixed around the water connector 12.

DESCRIPTION OF PREFERRED EMBODIMENTS

Figure 1:
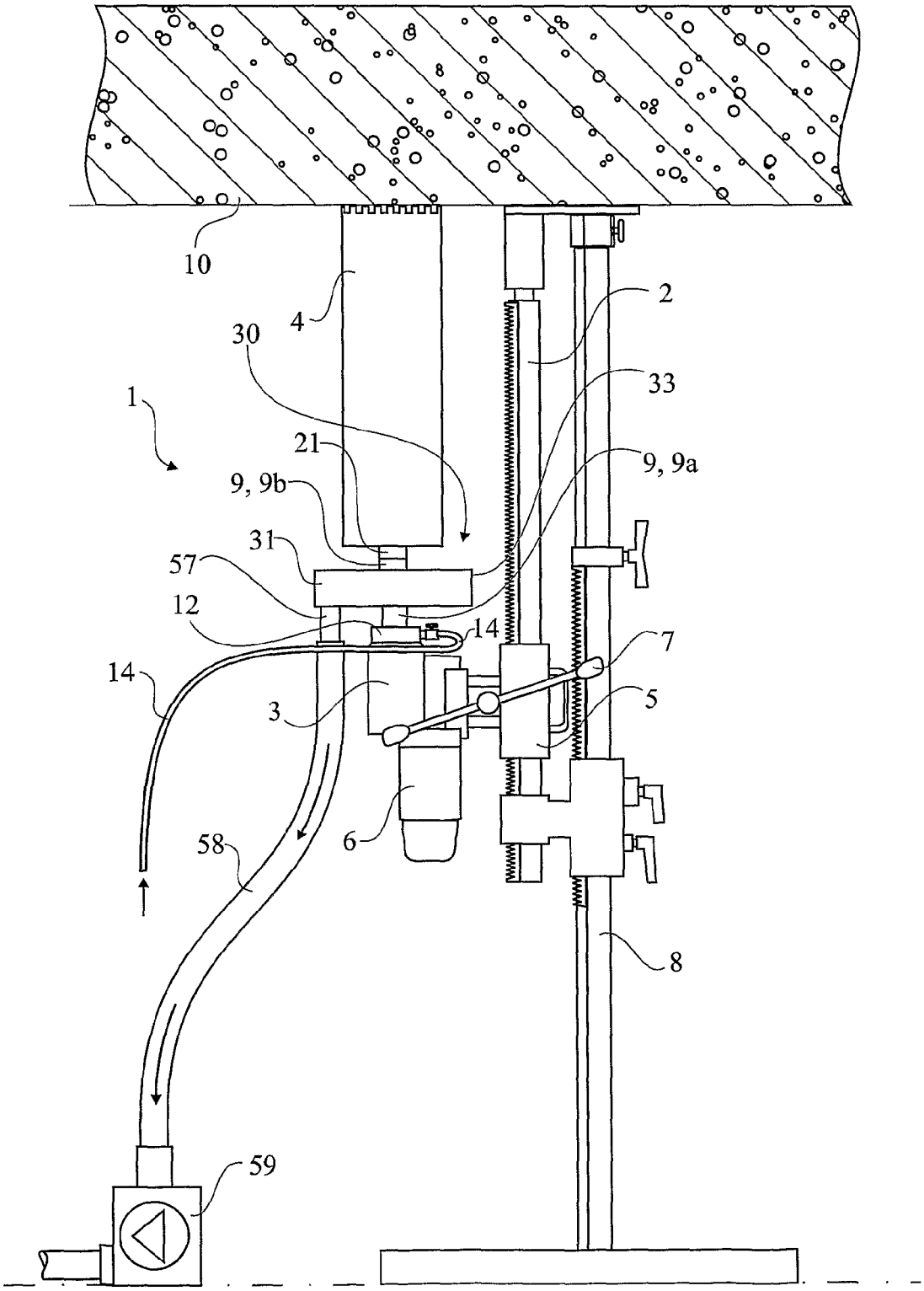
FIG. 1 shows a side view of a core drilling unit, that is equipped with a water collecting device according to the invention, but otherwise is of a known design.

With initial reference to FIG. 1, a core drilling unit is generally designated with the FIG. 1. The known main parts of the unit comprise a stand 8 with a pillar 2, a drilling machine comprising an electric drilling motor 6 and a machine housing 3 with an output machine shaft 9, to which a core drill 4 is connected, the drill motor 6 for rotation of the core drill 4 via the machine housing 3, a feeding housing 5 that carries the machine housing 3 and that is movable along the pillar 2, and a feeding handle 7 for manual feeding of the feeding housing 5 and thereby of the core drill 4. In the illustrated case, the stand 8 is vertical, the pillar 2 connected to a ceiling 10 and the core drill 4 aimed vertically upwards for drilling of a hole in the ceiling 10.

Figure 2:
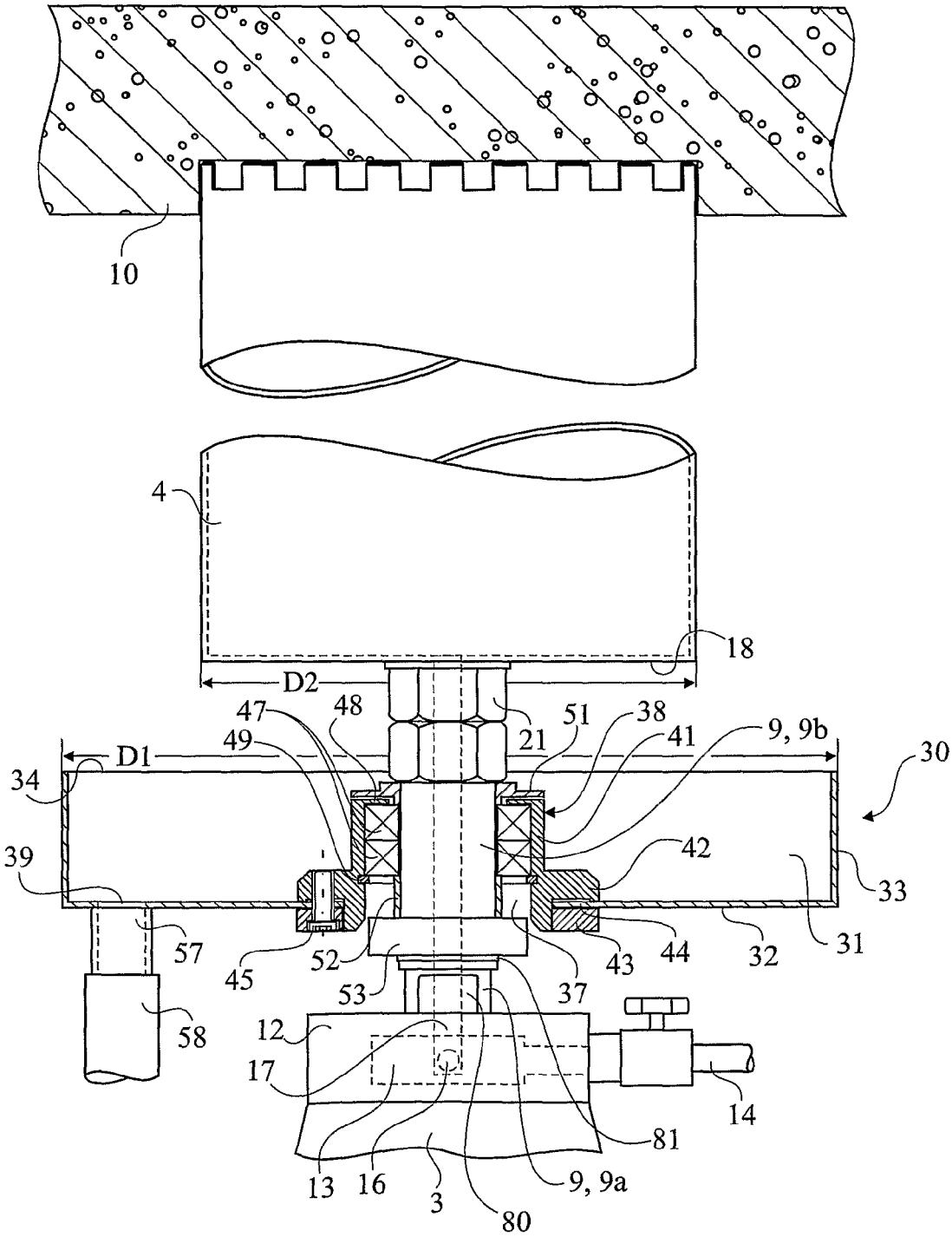
FIG. 2 shows a side view of the water collecting device in a greater scale, partly as a cross cut, according to a first preferred embodiment, and a machine shaft and a core drill connected to the shaft according to prior art.
Figure 3:
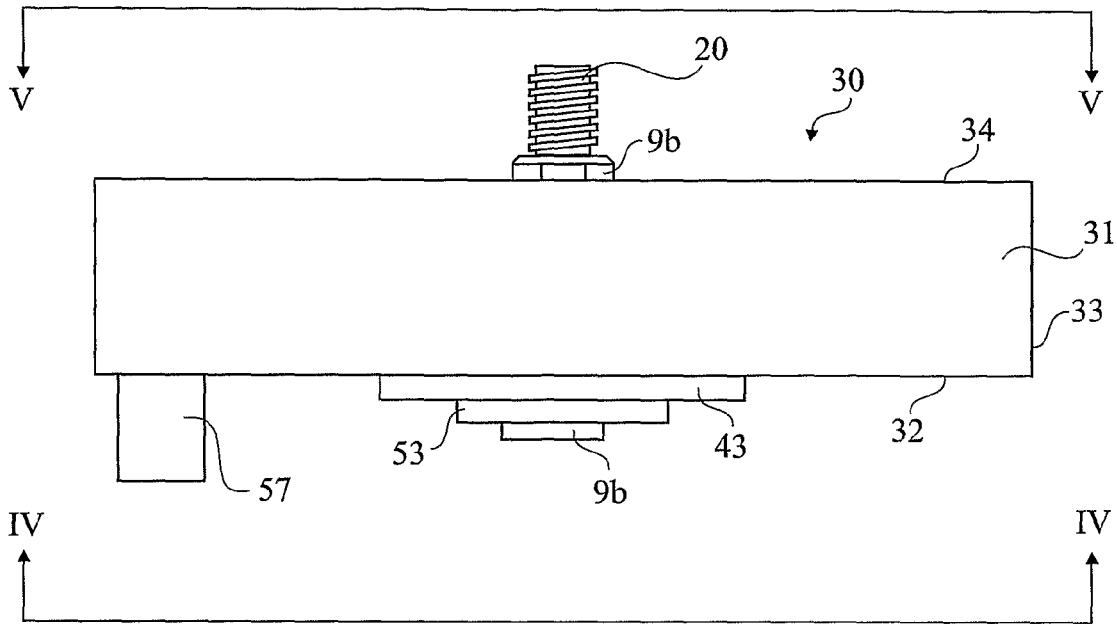
FIG. 3 shows a side view of the water collector according to the first preferred embodiment
Figure 4:
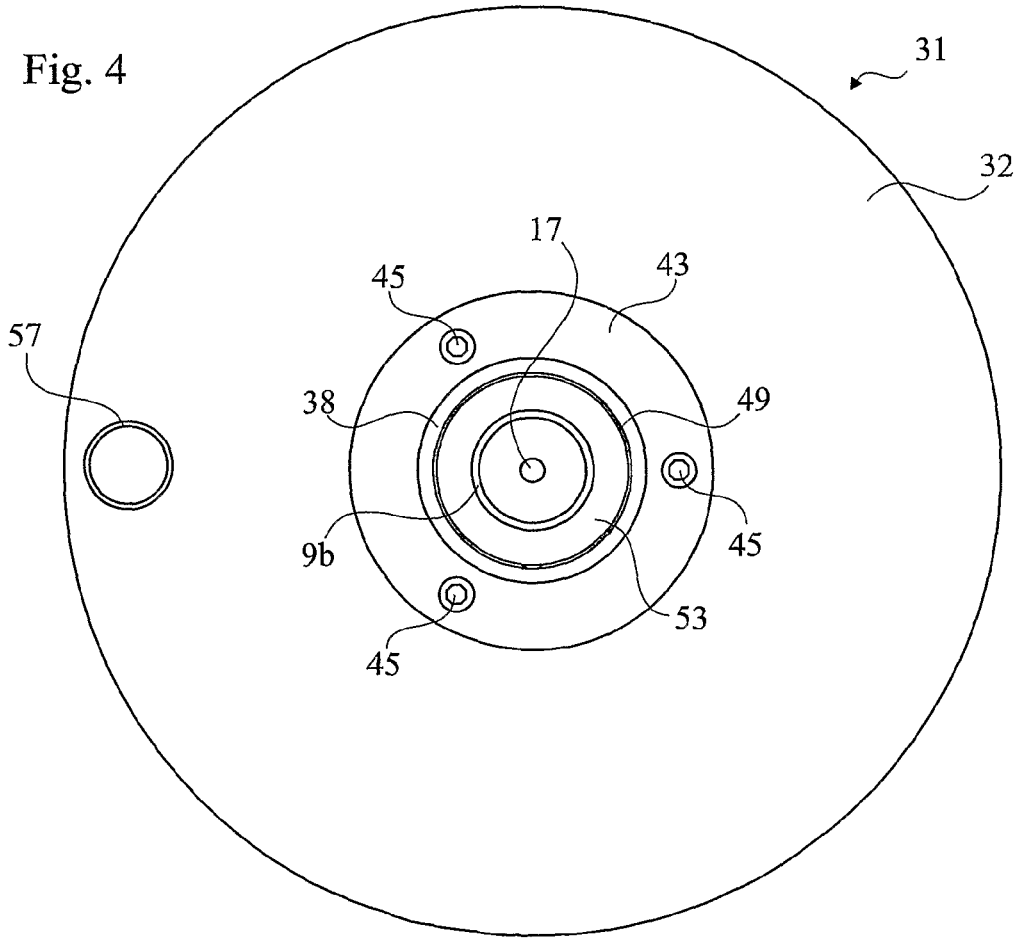
FIG. 4 shows the water collector in a view IV-IV in FIG. 3 according to the first preferred embodiment
Figure 5:
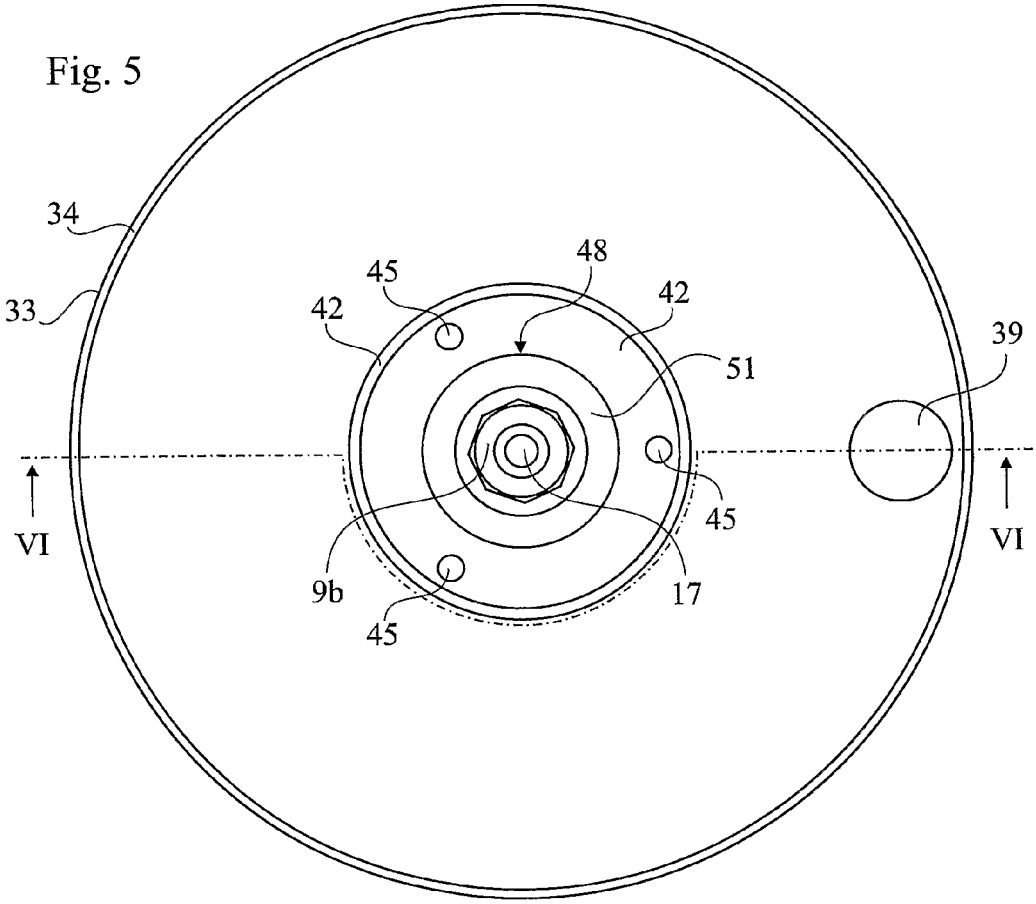
FIG. 5 shows the water collector according to the first preferred embodiment in a view V-V in FIG. 3.
Figure 6:
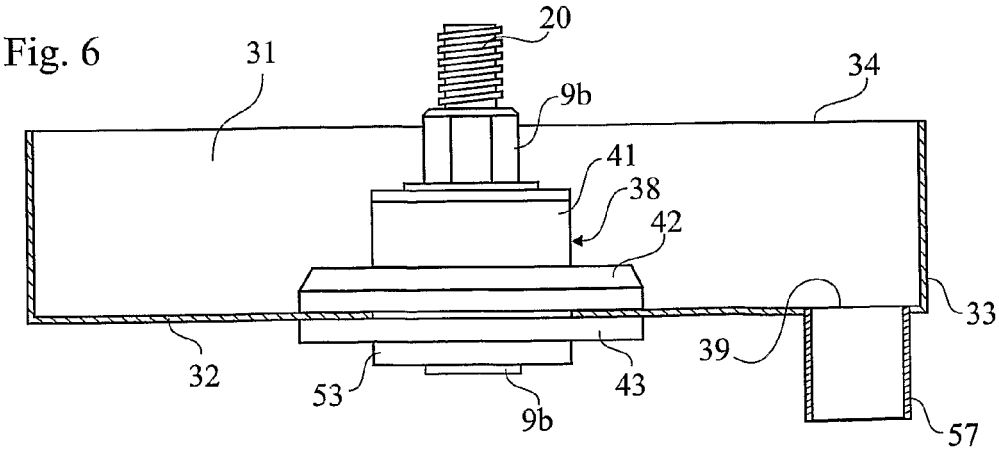
FIG. 6 shows a view according to VI-VI in FIG. 5 of a section of—adapter to—the machine shaft along with a bearing sleeve and a device for assembly of these components in the bottom of the vessel included in the water collecting device according to the first preferred embodiment.

The machine shaft 9 comprises, in a known manner, two sections; a first section 9*a*, FIG. 2, that forms the output shaft from the machine housing 3, and a second section 9*b*—adapter—FIG. 6. The adapter 9*b*, i.e. the upper section of the machine shaft 9, is provided with inside threads in its lower end, while the first section 9*a* of the shaft is provided with a matching screw thread in its upper end. Thus, the two sections are connected with each other via a screw/nut coupling. Furthermore, in a known manner there is a so called water connector 12, which is fixed to the machine housing 3. In the water connector 12, there is a cavity 13 in a known manner, see FIG. 2. A hose 14 for supply of cooling water is connected to the water connector 12, in connection with the cavity 13. The machine shaft 9 with its section 9*a* extends through the water connector 12. Sealing devices—not shown—are arranged to prevent water leakage. Furthermore, section 9*a* of the machine shaft is provided with a hole 16 in the area of the cavity 13, this hole extending into a channel 17, that extends centrally up through the entire shaft 9, exiting just above the plane bottom 18 of the core drill 4. Section 9*a* of the machine shaft can be provided with two opposing chamfers 80 so that the machine shaft 9*a* can be held with a wrench while mounting the vessel.

The upper end of the machine shaft/adapter 9*b* is provided with a screw thread 20 that is matching a nut 21, that is welded onto the underside of the bottom 18 of the cylindrical core drill 4. Via mentioned screw thread 20 and nut 21, the core drill 4 is, in a known manner, mounted coaxially on the integrated machine shaft 9.

The above mentioned belongs to prior art. What is characteristic for the invention is the water collector (water collecting device) that generally has been designated 30 and accompanying devices for mounting of the water collector between the drilling machine 3 and the core drill 4 besides devices for draining off the collected cooling water with accompanying drill cuttings. The water collecting device/the water collector 30 comprises a vessel 31. According to the embodiment, the vessel 31 is made of steel sheet, but other metals are also conceivable, as for instance plastic, in particular reinforced, impact resistant plastic materials. According to the embodiment, the vessel 31 has furthermore the shape of a circular, cylindrical vessel with a plane bottom 32 and a surrounding cylindrical wall 33, but, as mentioned in the initial part of the description, other shapes are also conceivable. Of importance is however that the vessel 31 has such a width, i.e. that the upper edge 34 of the vessel 31 has a diameter D1, which is significantly larger than the diameter D2 of the core drill 4, so that all the water flowing down the outside of the drill 4 shall be captured in the vessel 31.

In the bottom of the vessel 31 there are two holes, partly one centrally positioned, larger hole 37 for mounting of a bearing housing 38 for supported passage of the machine shaft 9, partly a peripheral, smaller draining hole 39.

The bearing housing 38 extends with a socket-shaped, cylindrical section 41 upwards within the vessel 31. A mounting flange 42 extends radially outwards from the socket-shaped section 41 on the inside of the vessel's 31 bottom 32 adjacent to the rim of the central hole 37. On the underside of the bottom 32, there is a mounting ring 43 below the mentioned rim section, designated 44. The rim section 44 is, including a seal, clamped between the mounting flange 42 and the mounting ring 43 by means of screws 45.

Two ball bearings 47 are with press fit pressed into the socket-shaped section 41 of the bearing housing 38, where they are fixed between an upper flange 48, that extends radially inwards from the upper end of the socket section 41, and a retaining ring 49. Above the upper flange 48, on the upper section 9*b* of the machine shaft 9, there is a water trap mounted in form of a water deflecting ring 51 that prevents the water from flowing into the ball bearings 47.

Below the bearings 47, there are a spacer ring 52 on the shaft 9 and below that a clamping ring 53, that makes sure that the unit is kept together. The ball bearings 47 are threaded with a fit onto the upper section 9*b* of the shaft 9.

The parts rotating with the machine shaft 9 comprise the drill 4, the water deflecting ring 51, the inner rings of the ball bearings 47, the spacer ring 52 and the clamping ring 53. The non-rotating parts comprise the actual water collector 30 including its vessel 31, bearing housing 38, the outer rings of the ball bearings 47 and the retaining ring 49. On the underside 32 of the vessel 31 there is a tube socket 57 connected to the drainage opening 39. A draining hose 58 extends from the tube socket 57 to a suction pump 59 for removal of cooling water and drill cuttings that have gathered in the vessel 31. The draining hose 58 with the pump 59 are also functioning as a rotational stop/anchor for the vessel 31.

The above described core drilling unit with its water collector is functioning in the following way. When a hole shall be made in a ceiling, the core drilling unit 1 including the core drill 4 is turned to the vertical position as shown in FIG. 1 and FIG. 2. The drill 4 is fed towards the ceiling 10 by means of the feeding handle 7. The cylindrically, socket-shaped drill 4 is filled with cooling water through the hose 14, the water connector 12 with the cavity 13, the hole 16 and the duct 17, after which the drill motor 6 is started so that the machine shaft 9 with the drill 4 is starting to rotate. The water collector 30 does not take part in this movement, since the very weak turning force stemming from the ball bearings 47 is balanced by the draining hose 58 with the suction pump 59, which act as an anchor. As the drill 4, equipped with diamonds in its upper part, is cutting itself upwards into the ceiling 10, the spent cooling water including the drill cuttings is flowing across the upper edge of the drill and down along the outside of the drill 4 to be collected in the vessel 31. From there the water including the therein suspended drill cuttings is drained away through the drainage hole 39, the tube socket 57 and the hose 58 by means of suction by the suction pump 59.

Figure 7:
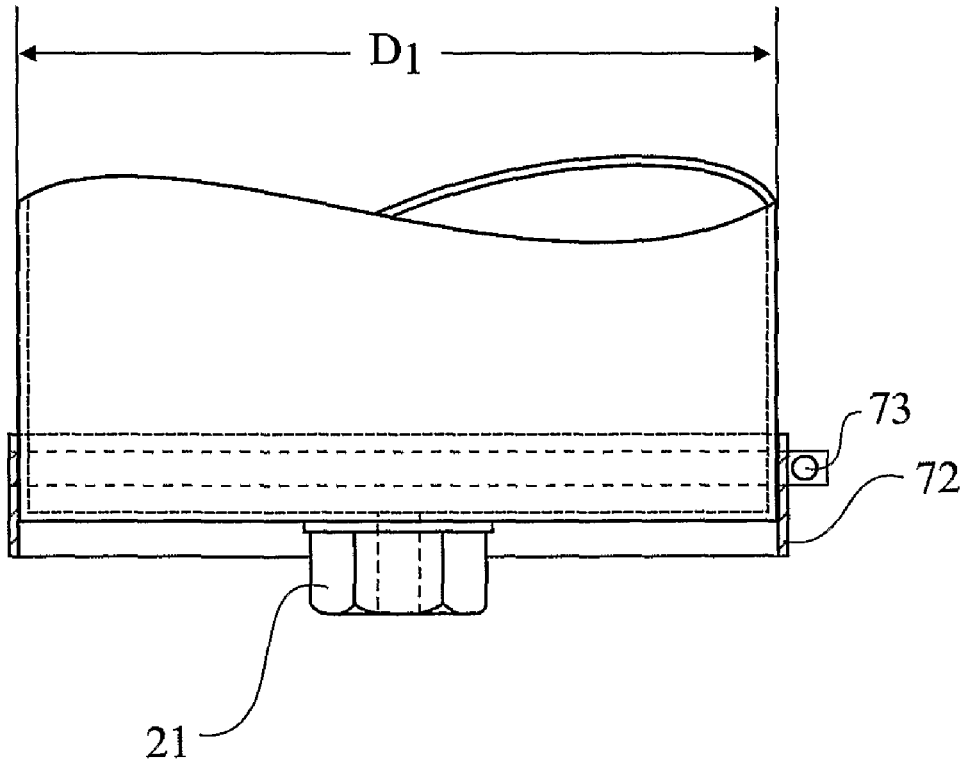
FIG. 7 shows a side view of the lower portion of the core drill, where the core drill is provided with a detachable sleeve.

In FIG. 7, the core drill 4 is shown with a detachable sleeve 72. The detachable sleeve 72 is attached to the lower part of the core drill by means of a tensioning strap 73. The professional naturally realises that the detachable sleeve can be fastened in several different ways. The detachable sleeve 72 is sealed against the core drill 4 and the lower part of the detachable sleeve 72 is protruding below the bottom of the core drill 4. Thereby a circular, downwardly protruding edge is formed on the core drill 4. The detachable sleeve 72 prevents the spent water flowing downwards along the sides of the core drill 4 to flow along the bottom of the core drill 4 towards the machine shaft 9, since the water cannot flow upwards along the inside of the sleeve 72.

In FIG. 8-9, two more embodiments are shown, where the water collecting device 30 is not supported by bearings around the machine shaft 9, but instead fixed to the upper part of the machine housing 3, to the water connector 12. In other words, the main difference between the preferred embodiment according to FIG. 2-6 and the embodiments according to FIG. 8 and FIG. 9 is that the first socket 41, having a bearing arrangement against the machine shaft 9, has been replaced by a second sleeve 61 fixed to the water connector 12. In the embodiments according to FIG. 8 and FIG. 9, the first section 9*a* of the machine shaft 9 is not shown, but only a threaded part of the first section 9*a* is protruding from the water connector 12, on which threaded part the second section 9*b* of the machine shaft 9 is screwed on, whereby the threaded part is concealed by the screwed on second part 9*b*.

The embodiments according to FIG. 8 and FIG. 9 differs from each other in that FIG. 8 shows a second inner flange 63 and a water deflecting third flange 65 whereas FIG. 9 shows a conical covering plate 66 with a sealing 68. Otherwise the invention in FIG. 8 and FIG. 9 has the same basic concept.

In the bottom 32 of the vessel 31 there are two holes, partly one centrally positioned, larger hole 37 for mounting of a second sleeve 61, partly a peripheral, smaller draining hole 39. The second sleeve 61 is fixed around the water connector 12 on the machine housing 3 by means of tightening a fastening screw 69. Furthermore, the second sleeve 61 is sealed against the water connector 12.

On the underside 32 of the vessel 31, there is a tube socket 57 connected to the drainage opening 39. A draining hose 58 extends from the tube socket 57 to a suction pump 59 for draining away the cooling water and the drill cuttings that have gathered in the vessel 31 (see FIG. 1). The draining hose 58 with the pump 59 are also acting as a rotational stop/anchor for the vessel 31.

The second sleeve 61 extends upwards in the vessel 31. A second mounting flange 62 extends radially outwards from the upper part of the second sleeve 61 on the inside of the bottom of the vessel 31 adjacent to the rim 44 of the central hole 37. On the underside of the bottom 32 there is a mounting ring 43 below the mentioned rim section 44. The rim section 44 is, together with a sealing, clamped between the second mounting flange 62 and the mounting ring 43 by means of screws 45. Opposed to the first embodiment (FIG. 2-6), the screws 45 are not penetrating into the bottom 32 of the vessel, but the screws 45 are situated within the central hole 37. This implies that the vessel can be turned around its own axis, at the same time as the second sleeve 61 is fixed against the water connector 12, either by means of slightly loosening the screws 45, or by means of not tightening the screws 45 very hard from the beginning. The vessel's bottom 32 has been bent at the hole 37 in order to form an outer trough 70 in the vessel 31, i.e. the rim section 44 is on one level higher than the remaining bottom 32. The outer trough 70 reduces the demands on the sealing between the second mounting flange 62 and the rim section 44.

An inner space 71 is formed between the second sleeve 61 and the machine shaft 9, in which inner area the upper side of the water connector 12 is functioning as a bottom. The machine shaft 9 is arranged in a rotating manner and sealed to prevent spent water and drill cuttings from entering the machine housing 3 via the machine shaft 9. It is however advantageous if as little as possible of water and drill cuttings respectively enter into the inner space 71. The majority of the spent water will drip down from the sides of the core drill 4 to the outer trough 70 due to the influence of gravity. However, it may occur that water is finding its way along the underside of the core drill 4 towards the machine shaft 9. The detachable sleeve 72 in FIG. 7 is one way of preventing water from flowing along the underside of the core drill 4 and it can be combined with both the bearing supported water collecting device 30 with rotating properties, FIG. 2-6, and the fixed water collecting devices 30, FIG. 8-9.

In FIG. 8, the second sleeve 61 has been equipped with a second inner flange 63 that is extending radially along the water collector's 12 upper side, in towards the machine shaft 9 and thereby the inner space 71 is reduced. Preferably, the second inner flange has a downward inclination directed towards the outer trough 70. Furthermore, the machine shaft 9*b*, 9 has been equipped with a third flange 65. The third flange 65 extends radially from the machine shaft 9 above the inner area 71 and the inside of the second inner flange 63.

FIG. 9 shows a cone shaped cover plate 66 covering the inner area 71, where the apex of the cone is directed towards the core drill 4. The cover plate 66 has a centrally positioned hole in the apex of the cone for the machine shaft 9. The cone shaped cover plate 66 may for instance consists of a material that allows the cone to be somewhat flexible in the vertical direction, for instance a plastic material. The cone shaped cover plate 66 is pressed at the apex of the cone by a radially extending part 67, preferably a nut part, on the second section 9*b* of the machine shaft 9 against the top side of the second mounting flange 62. Furthermore, a seal 68 is arranged with low friction between the top of the cover plate 66 and the radially extending part 67. The water collecting device in FIG. 9 will of course work even if the cover plate 66 is not used.

Figure 10:
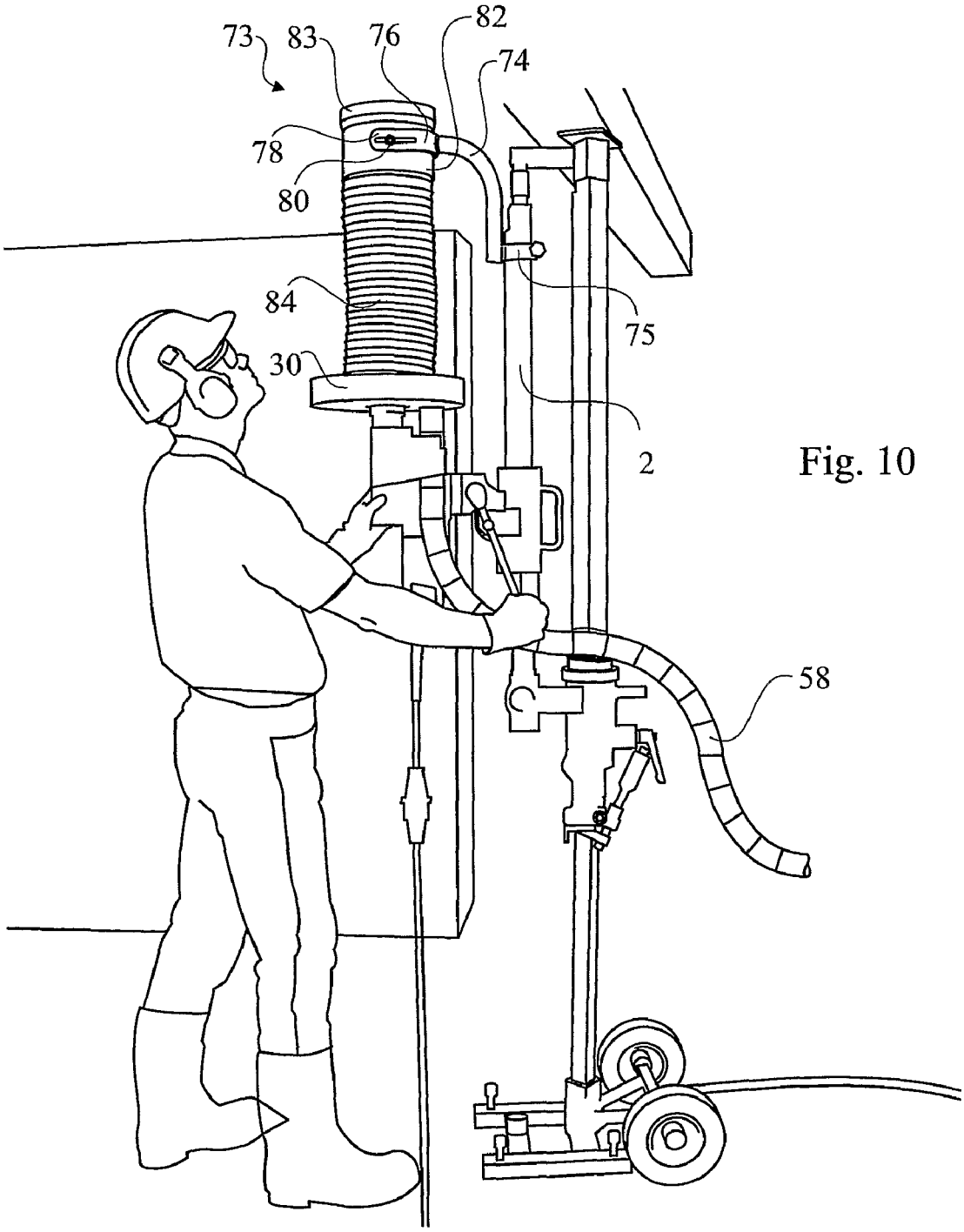
FIG. 10 shows in perspective a drilling in a ceiling, whereby a special dirt protector surrounds the drill and extends from up in the ceiling down into the water collecting device.

FIG. 10 shows a drilling in a ceiling whereby a special dirt protector 73 surrounds the drill and extends all the way from the ceiling down to the water collecting device 30. Thus the dirt protector can handle both potential dust and liquid splashing and guide it down into the water collecting device 30, from where it is sucked out through the hose 58. Hereby the room is not at all made as dirty as without the dirt protector and the operator's work environment is clearly improved.

The dirt protector comprises a holding bracket 74 with a stand clamp 75, in its lower end clamped in an upwards and downwards adjustable manner to the pillar 2, as well as the actual core drilling unit. In its upper end, the holding bracket has a fastening fork with two legs 76, 77, each with an oblong hole 78, 79, and fasting screw 80,81, which are fastened to a carrier sleeve 82. The carrier sleeve carries a ceiling seal 83 on its top side and a protective bellows 84 on its underside. In a lowered position, the dirt protector is adjusted by means of the screws 80, 81 and it is then elevated so that the ceiling seal is pressed against the ceiling. The parts 77, 79 and 81 are concealed and cannot be seen in the figure, but they correspond to the symmetrically positioned visible parts 76, 78 and 80.

The invention is not limited to the above mentioned embodiments, but can be varied within the scope determined by the patent claims. For example, the water can be supplied to the cylindrical inner part of the core drill also through holes in the lower end of the core drill. That would require a still standing, ring shaped member with water supply. Such a member is then suitably sealed against the underside of the core drill, directly or via intermediate members.

The invention claimed is:

1. A drilling machine comprising:

an electric drilling motor;

a machine housing with a machine shaft;

a core drill that is connectable with the machine shaft;

cooling water supply to supply cooling water, as required, to a cylindrical inner part of the core drill; and a water collecting device comprising:

a vessel with a bottom and a side wall, wherein the water collecting device is mounted so the vessel bottom is positioned in a fixed position in relation to the core drill and the bottom being positioned below the core drill, the vessel arranged to collect spent water as well as drill cuttings from the core drill, the vessel further comprising at least a draining duct for drainage of spent water as well as drill cuttings from the vessel.

2. A drilling machine according to claim 1, further comprising at least a first hole in the bottom of the vessel, and that the drilling machine is arranged in the first hole so that the side wall of the vessel surrounds at least some part of the drilling machine.

3. A drilling machine according to claim 2, wherein the water collecting device also comprises a second hole in the bottom of the vessel, that constitutes a draining hole and that the draining duct is connected between the draining hole and a suction pump.

4. A drilling machine according to claim 2, wherein adjacent to the first hole, a bearing housing arranged with a seal against the bottom of the vessel, at least one bearing arranged in the bearing housing, through which the machine shaft, in a bearing supported manner, can extend when the vessel is mounted in the core drilling unit in such a way that the machine shaft can rotate in a bearing supported manner within the vessel.

5. A drilling machine according to claim 4, wherein the bearing housing extends at least a certain distance upwards in the vessel from the vessel bottom.

6. A drilling machine according to claim 4, wherein the bearing housing comprises a member, mainly in the shape of a first socket, contained in the vessel.

7. A drilling machine according to claim 6, wherein a mounting flange extends radially outwards from the lower part of the first socket and that the bearing housing is mounted in the first hole in the bottom of the vessel, fastened with a section, adjacent to the first hole, between the mounting flange above a rim section of the vessel and a mounting ring below the rim section.

8. A drilling machine according to claim 4, wherein the at least one bearing is fastened in a first socket between an upper first flange, that extends radially inwards from an upper end of the first socket, and a retaining member, recessed in a wall on the inside of the first socket.

9. A drilling machine according to claim 4, wherein a water trap is arranged above the bearing housing, preventing water from flowing down into the at least one bearing.

10. A drilling machine according to claim 4, wherein the bearing comprises one or more ball bearings.

11. A drilling machine according to claim 4 wherein the bearing comprises two ball bearings.

12. A drilling machine according to claim 2, further comprising a second sleeve, arranged in the first hole, wherein the second sleeve is arranged between the vessel and an upper part of the machine housing, the second sleeve sealed against the upper part of the machine housing and the vessel.

13. A drilling machine according to claim 12, wherein a second mounting flange extends radially outwards from the upper part of the second sleeve and that the vessel, via a rim section of the vessel adjacent to the first hole, is fastened between the second mounting flange above the rim section and a mounting ring below the rim section.

14. A drilling machine according to claim 12, wherein the second sleeve protrudes above the bottom of the vessel so that an inner space around the machine shaft is separated from an outer trough of the vessel.

15. A drilling machine according to claim 14, wherein the second sleeve has an inner second flange extending inwards towards the machine shaft that reduces the inner space around the machine shaft.

16. A drilling machine according to claim 14, wherein the machine shaft comprises a third flange, wherein the third flange extends in a radial direction, covering the inner space around the machine shaft.

17. A drilling machine according to claim 14, further comprising a conically shaped cover plate, covering the inner space, the cover plate arranged with a central hole for the machine shaft, and where an apex of the conically shaped cover plate is directed towards the core drill.

18. A drilling machine according to claim 17, wherein the conically shaped cover plate is arranged to be vertically flexible and that a radially extending part of the machine shaft is configured to press the cover plate, at the apex of the conically shaped cover plate, against the top side of the second mounting flange.

19. A drilling machine according to claim 18, wherein a sealing ring with low friction is arranged between an extended part and a top of the conicallv shaped cover plate.

20. A drilling machine according to claim 2, wherein the bottom of the vessel bends adjacent to the first hole so that a rim section of the hole is positioned on a level closer to the core drill.

21. A drilling machine according to claim 1, wherein an upper part of the machine housing comprises a water collector to supply cooling water to the cylindrical inner part, via the machine shaft of the drilling machine.

22. A drilling machine according to claim 21, wherein the side wall of the vessel is level with or above the water collector.

23. A drilling machine according to claim 1, wherein the vessel comprises an outer trough along the side wall of the vessel, and the outer trough is arranged to collect a majority of the spent water and the drill cuttings, wherein the draining duct is arranged adjacent to the outer trough.

24. A drilling machine according to claim 1, wherein a height of the vessel corresponds to 10-40% of the diameter of the vessel.

25. A drilling machine according to claim 24, wherein the height of the vessel corresponds to 20-30% of the diameter of the vessel.

26. A water collecting device according to claim 1, wherein the core drill comprises a cylinder with a top part and a bottom part, wherein the top part of the core drill comprises a drilling surface, and the vessel is below the bottom part of the core drill.

27. A core drilling unit comprising a drilling machine comprising:

an electric drilling motor;

a machine housing with a machine shaft;

a core drill connected to the machine shaft; and means to supply cooling water to a cylindrical inner part of the of the core drill, wherein the core drilling unit is equipped with a water collecting device comprising:

a vessel, mounted below the core drill, a diameter of the bottom of the vessel being larger than a diameter of the core drill, the vessel comprising at least one draining duct in order to remove spent cooling water including drill cuttings in the vessel.

28. A core drilling unit according to claim 27, further comprising a detachable sleeve, surrounded and sealed against a lower end of the core drill above the vessel, the detachable sleeve extending below an underside of the core drill, whereby spent water and drill cuttings are prevented from flowing along the bottom of the core drill towards the machine shaft.

29. A core drilling unit according to claim 27, wherein a dirt protector is arranged so that it, while drilling, surrounds the drill and connects with a ceiling and to the water collecting device.

30. A core drilling unit according to claim 29, wherein the dirt protector has a variable length so that it can be compressed when drilling.

31. A core drilling unit according to claim 27, wherein the core drill comprises a cylinder with a top part and a bottom part, wherein the top part of the core drill comprises a drilling surface, and the vessel is below the bottom part of the core drill.

32. A core drilling unit according to claim 31, wherein the vessel is in a fixed position in relation to the core drill.

33. A core drilling unit comprising:

a drilling machine including an electric drilling motor;

a machine housing with a machine shaft, that can be composed of many sections;

a core drill connected to the machine shaft and means to supply cooling water to a cylindrical inner part of the core drill; and a water collecting device comprising:

a vessel with a bottom and a side wall, wherein the vessel is mounted so the vessel bottom is positioned in a fixed position in relation to the core drill and the bottom being positioned below the core drill, the vessel arranged to collect spent water as well as drill cuttings from the core drill, the vessel further comprising at least a draining duct for drainage of spent water as well as drill cuttings from the vessel.

34. A core drilling unit according to claim 33, wherein the core drill comprises a cylinder with a top part and a bottom part, wherein the top part of the core drill comprises a drilling surface, and the vessel is below the bottom part of the core drill.

* * * * *